US005295885A

United States Patent [19]

Karl

[11] Patent Number: 5,295,885

[45] Date of Patent: Mar. 22, 1994

[54] INNER TUBE HAMMOCK/SEAT FOR WATER/SNOW RECREATION

[76] Inventor: Thomas P. Karl, 307 Mt. Vernon Ave., Alexandria, Va. 22301

[21] Appl. No.: 18,002

[22] Filed: Feb. 16, 1993

[51] Int. Cl.[5] ..... B63D 35/76

[52] U.S. Cl. ..... 441/131

[58] Field of Search ..... 441/81, 131, 67, 66; 280/18.1; 472/129

[56] References Cited

U.S. PATENT DOCUMENTS

| | | | |
|---|---|---|---|
| D. 263,616 | 3/1982 | Canty | D29/2 |
| 1,190,743 | 7/1916 | Fageol | 441/131 |
| 2,562,080 | 7/1951 | Barnes | 441/131 |
| 2,683,270 | 7/1954 | Long | 9/11 |
| 2,720,664 | 10/1955 | Gray | 9/1 |
| 2,724,843 | 11/1955 | Kimball | 9/17 |
| 2,958,876 | 11/1960 | Garrett | 9/347 |
| 3,036,316 | 5/1962 | Schuster | D21/237 |
| 3,095,586 | 7/1963 | Baier | 441/81 |
| 3,324,488 | 6/1967 | Schulz | 9/1 |
| 3,748,672 | 7/1973 | Patrick | 9/347 |
| 3,871,042 | 3/1975 | Farmer | 9/1 A |
| 4,427,394 | 1/1984 | Felter | 441/131 X |
| 4,464,132 | 8/1984 | Mauck | 441/81 |
| 4,552,539 | 11/1985 | Hoenstine | 441/66 |
| 4,619,620 | 10/1986 | Felter | 441/66 |
| 4,795,387 | 1/1989 | Morgan | 441/130 |

*Primary Examiner*—Sherman Basinger

[57] ABSTRACT

This invention relates to an inner tube-type recreation vehicle with an attachable/detachable hammock-like seat in the central opening of the inner tube to support users as they sit across the inner tube's central opening, with head, arms, and shoulders over one end, and feet over the other end. The seat is comprised of straps that intersect in the center of the inner-tube's central opening. The invention includes a rope handle attached to the straps toward the outer periphery of the inner tube.

2 Claims, 5 Drawing Sheets

INNER TUBE HAMMOCK/SEAT FOR WATER/SNOW RECREATION

FIELD OF THE INVENTION

This invention relates to recreational vehicles and more particularly to inner tube-type recreational vehicles that are primarily adapted for floating on bodies of water such as, but not limited to, rivers, lakes, ocean surf, and pools, and on snow-covered hills.

DESCRIPTION OF PRIOR ART

Tubing is a popular recreational water/snow sport. Tubing is especially popular on, but is not limited to, rivers, lakes, ocean surf, pools, and snow-covered hills. Although inner tubes are popular because of their availability, durability, and low cost, there are several drawbacks to their use.

When using an inner tube in water/snow recreation, users often become fatigued because they must support themselves as they sit across the inner tube's center hole, with head, arms, and shoulders over one end, and feet over the other end, applying pressure against the inner tube to keep from falling through the center hole. Thus, providing a seat that supports inner tube users as they sit in the center hole allows them to be more comfortable and secure.

In addition, when using inner tubes on, but not limited to, rivers and lakes and in the ocean surf, users often become dislodged and separated from the inner tube. In addition, when inner tubes are wet, they are very slippery and difficult to hold. Thus, adding a rope handle to the inner tube assists users in maintaining control of the inner tube.

Further, inner tubes are often used in locations that are without easy access to compressed air. Thus, it would be a positive feature if the device could be easily attached to and detached from an inner tube while the inner tube is fully inflated or deflated. In addition, it would be beneficial to have the apparatus be assembled easily by individuals of all ages.

In addition, inner tubes are plain, usually black. Thus, it would be a positive feature to improve the appearance of the inner tube for recreation by adding a unique colorful design.

OBJECTS AND ADVANTAGES

Objects

Therefore, one of the objects of this invention is to provide a recreational vehicle of the inner tube-type with a seat that is primarily adaptable for carrying individuals and/or other matter in a more comfortable and more secure manner.

A further object of this invention is to provide a seat, composed by the intersection of straps in the center of the inner tube hole forming an inner tube seat, that is novel, unique, and colorful. The intersecting straps form the inner tube seat in a sling-like or hammock-like manner that resembles spokes of a wheel.

An additional object of this invention is to provide rope handles to assist users in maintaining control of the inner tube.

A further object of this invention is to provide an easily attached and detached apparatus that is easily assembled by individuals of all ages.

An additional object of this invention is to provide a low-cost recreational vehicle that individuals of all ages can use and enjoy.

A still further object of this invention is to promote recycling of used inner tubes versus purchasing new recreational vehicles that are produced by manufacturers solely for this type of purpose.

Differences

There are several differences from the prior art that make this invention novel and unique.

The invention described herein is different from prior art designed where the user's legs and feet go through the center hole, often referred to as "fisherman floats," since the invention described herein is designed so that the user sits across the center hole of the inner tube, with head, arms, and shoulders over one end, and feet over the other end supported by the hammock seat.

In addition, the invention described herein differs from prior art designed to be towed by another vehicle since it is not intended for this invention to be towed for any purpose or in any manner.

Further, the invention described herein differs from prior art where the inner tube seat is fastened to an apparatus that completely covers the inner tube hole. In the invention described herein, the straps intersect to form a seat in a sling-like or hammock-like manner. Water is allowed to flow freely through the apparatus.

In addition, the invention described herein is colorful and attractive in appearance.

Still further, the adjustable straps allow the hammock-like seat to accommodate different-size persons or other matter, and at different depths when used in water.

Advantages

There are several advantages of this invention over the prior art.

Since the invention does not involve attaching a seat that completely covers the inner tube hole, the user is able to interact more intimately with the environment in which the invention is being used, whether on rivers, lakes, ocean surf, pools, or on snow-covered hills.

In addition, the prior art do not have a rope handle that encircles the outer periphery of the inner tube, which enables the user to more easily maintain control of the inner tube during use.

Further, this invention can be used on inner tubes of many different sizes, different circumferences, different center hole sizes, etc., since the length of the straps and the placement of the means of fastening are adjustable.

Still further, the adjustable straps allow the hammock-like seat to accommodate different-size persons or other matter, and at different depths when used in water.

These and other objects and advantages of this invention will become apparent upon reading the following detailed description of a preferred embodiment thereof taken in conjunction with the accompanying drawings, although variations in modifications may be effected without departing from the spirit and scope of the novel concepts of the disclosure and in which:

DRAWING FIGURES

REFERENCE NUMERALS IN DRAWINGS

Reference 6 is an inner tube.

Reference 7 is a rope that forms the rope handles.

Reference 8 is a means for connecting the plurality of straps where they intersect in the center of the inner tube hole forming the inner tube seat.

Reference 9 is one of the straps.

Reference 10 is one of the straps.

Reference 11 is one of the straps.

Reference 12 is one of the straps.

Note: FIGS. 1-5 show the embodiment with four straps. The invention is not limited to any certain number of straps. The number of straps shown was chosen to illustrate the features of the invention.

Reference 13 is a means for attaching one of the plurality of straps to the means for attaching one of the plurality of straps located at Reference 15.

Reference 14 is a means for attaching the rope at Reference 7 to the plurality of straps.

Reference 15 is a means for attaching one of the plurality of straps to the means for attaching one of the plurality of straps located at Reference 13.

Reference 16 illustrates the connection of the two means for attaching the straps found at References 13 and 15.

DESCRIPTION: FIGS. 1 TO 5

Figure 1:
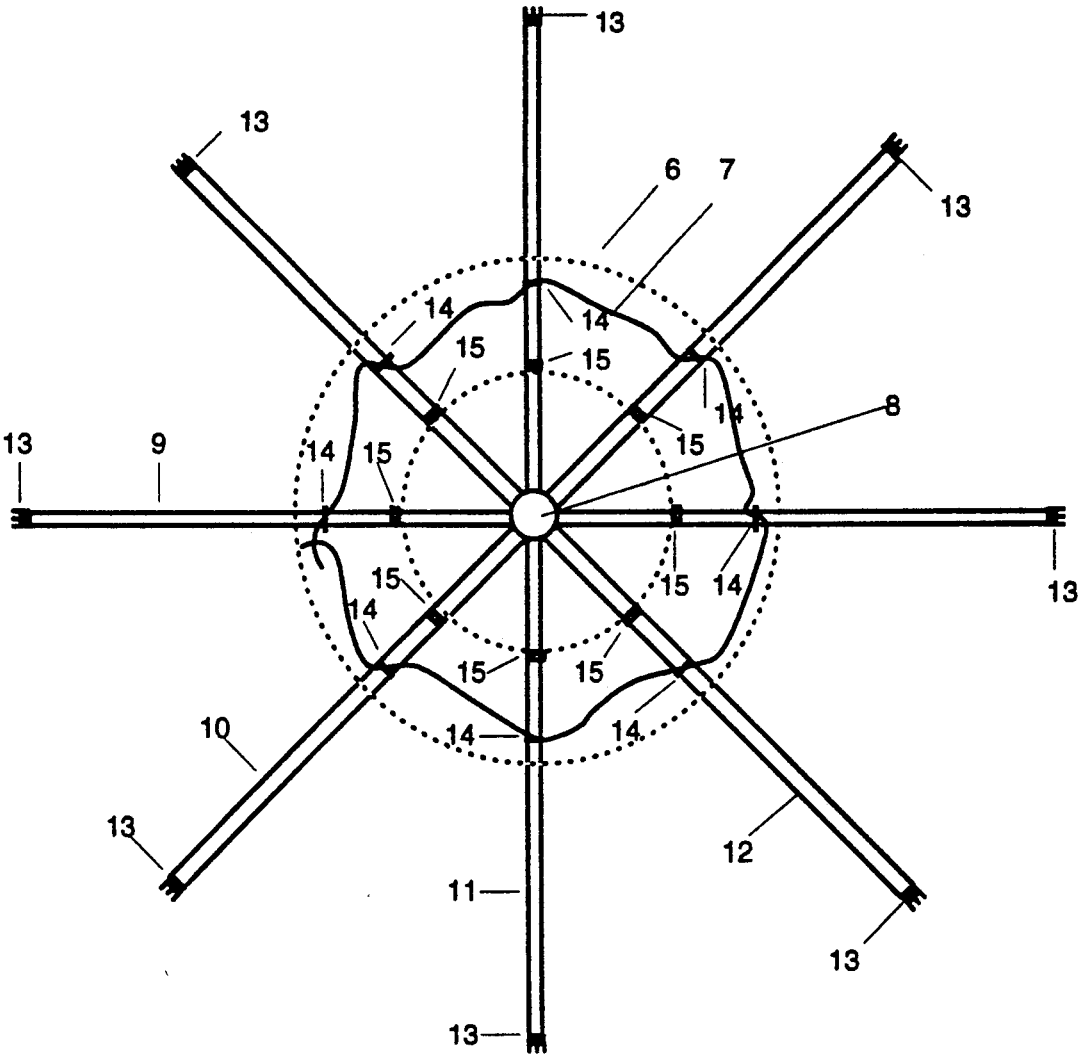
FIG. 1 is a view of the invention without the inner tube.
Figure 2:
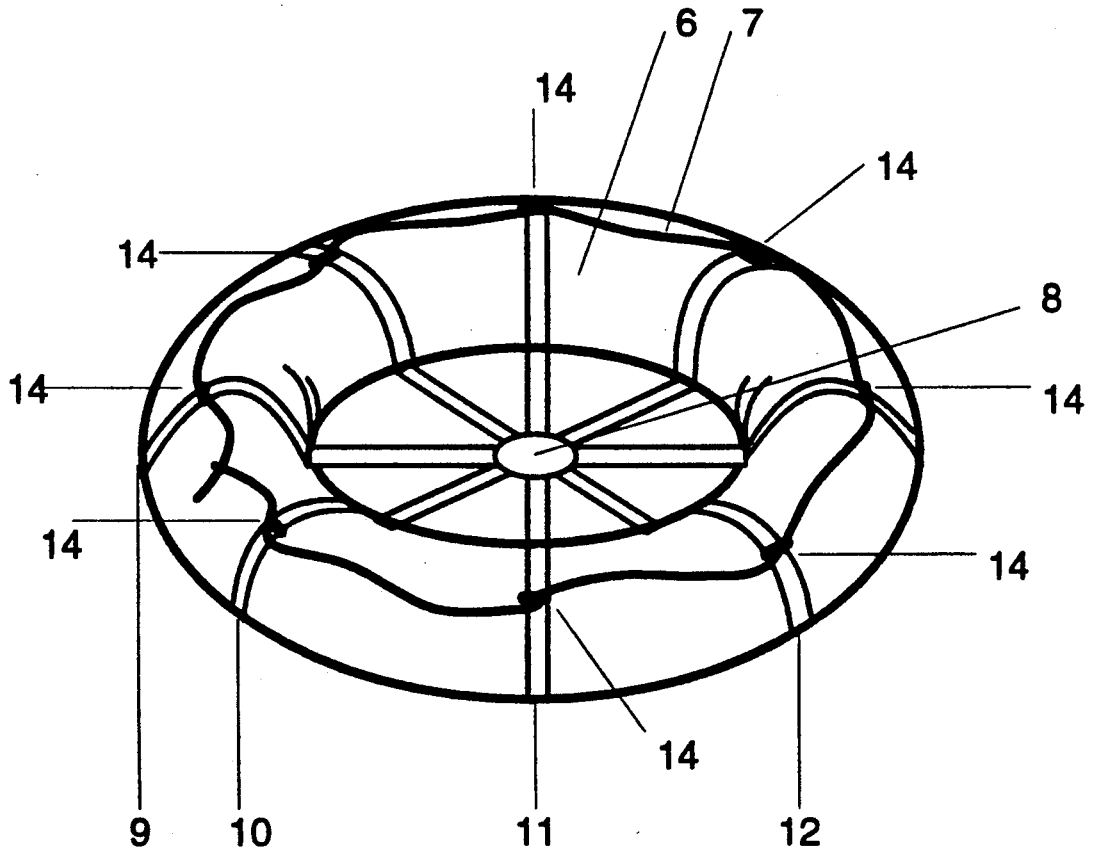
FIG. 2 is a top-side view of the inner tube-type recreational vehicle embodying the principal features of the invention including a seat formed by the intersection of a plurality of straps connected by fastening means with an attached rope handle.
Figure 3:
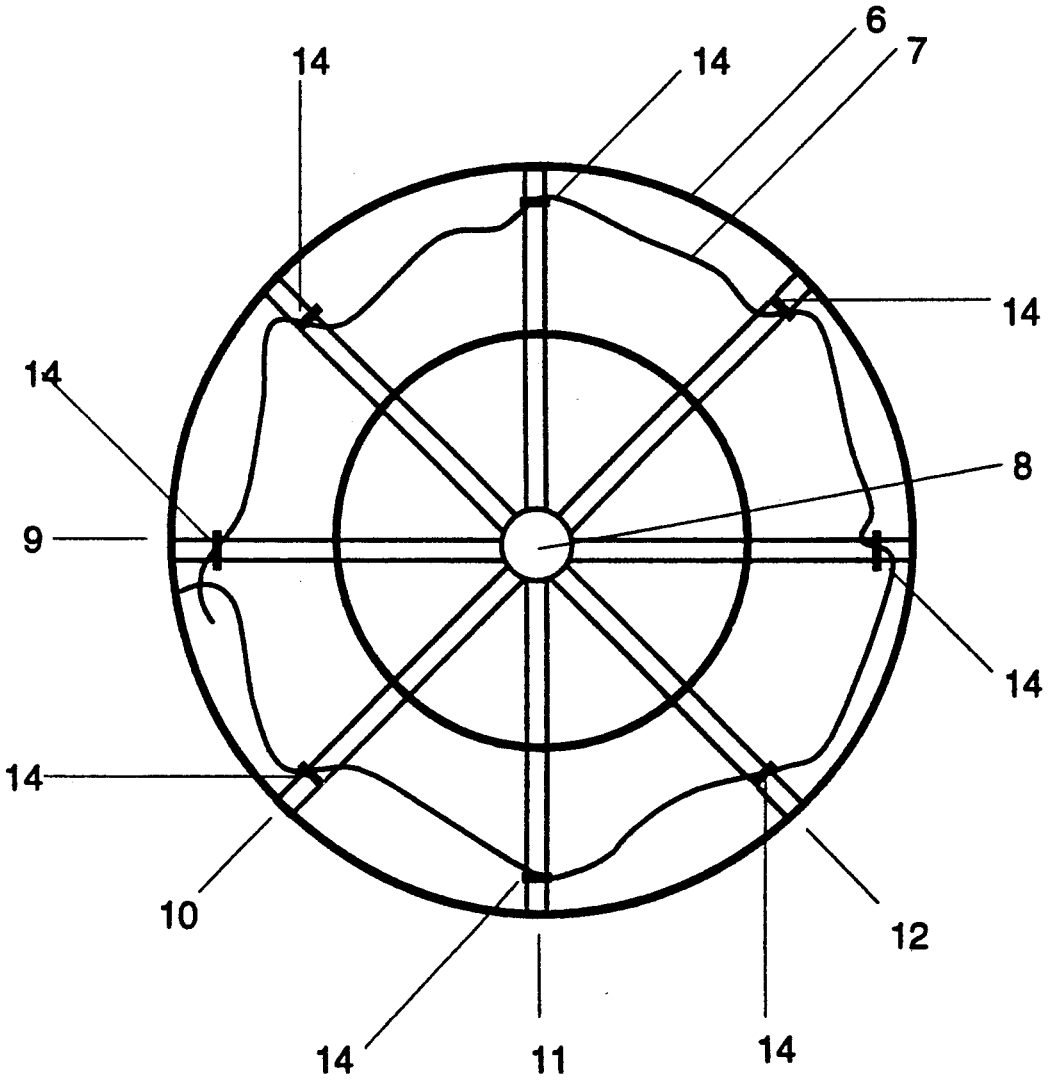
FIG. 3 is a top view of the inner tube-type recreational vehicle.
Figure 4:
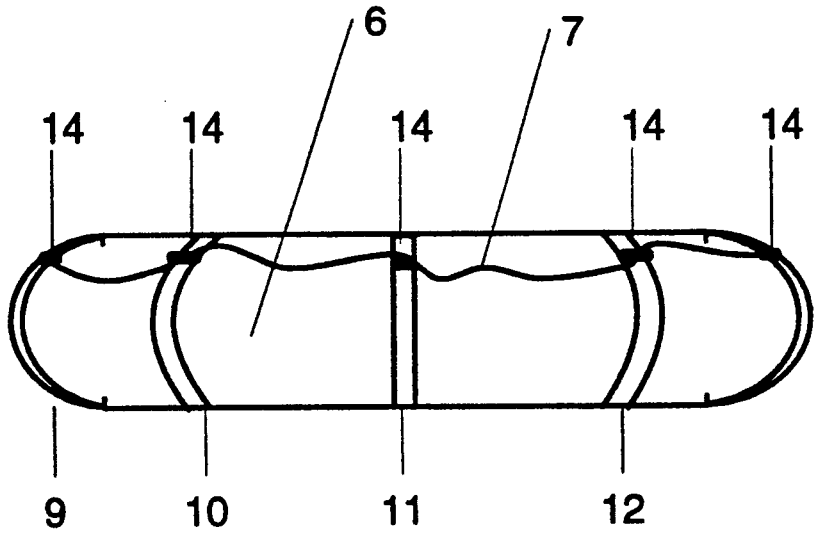
FIG. 4 is a side view of the inner tube-type recreational vehicle.
Figure 5:
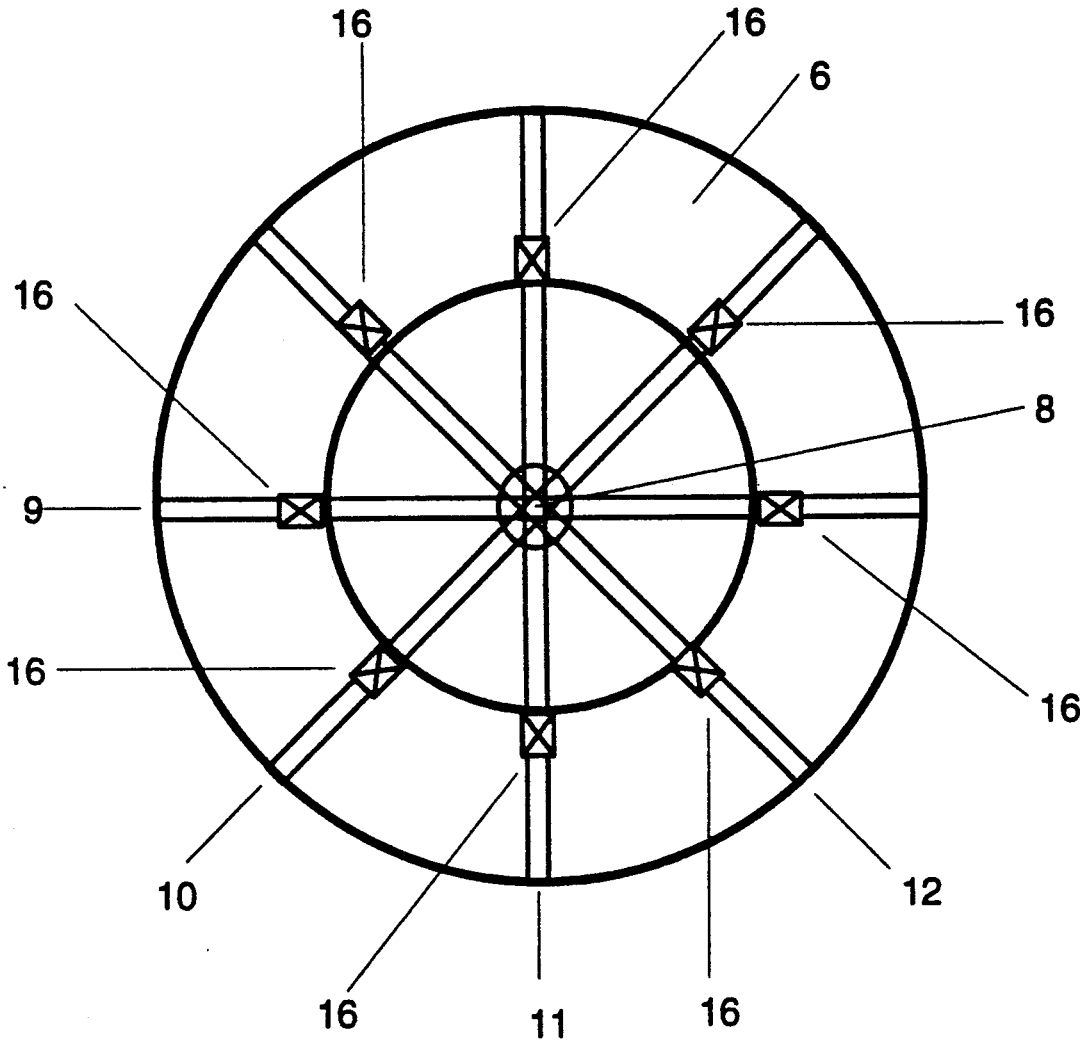
FIG. 5 is a bottom view of the inner tube-type recreational vehicle.

FIG. 1 illustrates the invention prior to attachment to the inner tube 6. As shown in FIG. 1, each of the plurality of straps 9, 10, 11 & 12 is connected at the point of intersection to a means of connection 8. As illustrated in FIGS. 2, 3 & 5, the means of connection 8 is positioned in the center of the inner tube hole. A means of connection 15 is attached at a point on each strap at a distance of one-half the diameter of the inner tube hole from the intersection of the strap where the plurality of straps are attached by a means of connection at 8. A means of connection 13 is attached at the end of each of the plurality of straps.

The recreational vehicle is formed when the apparatus is secured to the inner tube by placing the apparatus with the means of connection 8 in the center of the inner tube and extending each strap over the inner tube, as shown in FIGS. 2 & 3, and attaching the means of connection 13 to the means of connection 15 at the bottom of the vehicle, forming 16 on the bottom as shown in FIG. 5.

The hammock-like seat of the recreational vehicle is formed by the sections of straps from the connection of the means of connection 13 & 15 at 16 to the means of connection 8 located in the center of the inner tube hole. The apparatus when connected to the inner tube resembles spokes of a wheel.

As shown in FIGS. 1, 2, 3 & 4, the rope handle of the recreational vehicle is formed by attaching the rope 7 to each of the means of connection 14 that are attached to each strap. The rope handles encircle the periphery of the inner tube.

Operation: FIGS. 1 to 5

The apparatus can be easily attached to or detached from the inner tube 8 either before, during, or after the inner tube is inflated or deflated.

While operating the vehicle, the user sits across the inner tube center hole, being supported by the inner tube seat, with head, arms, and shoulders over one end of the inner tube, and feet over the other end. In addition, the vehicle can be used to support other matter such as, but not limited to, equipment, coolers, supplies, etc. The seat is formed by the hammock-like structure composed of the section of straps from the connection of the means of connection 13 & 15 at 16 to the means of connection 8 at the center of the inner tube hole. The user can hold on to the rope handles 7 in order to maintain control of the recreational vehicle and to prevent the user from being dislodged during use.

The user can then float or drift themselves or other matter on bodies of water such as, but not limited to, rivers, lakes, ocean surf, and pools, or slide on snow-covered hills.

Summary, Ramifications, and Scope

It is concluded that the invention described herein provides a novel, unique water/snow recreational flotation vehicle that utilizes an inner tube. Although it has been described with respect to the preferred embodiments, it is not to be so limited whereas changes or modifications may be made therein which are within the full intended scope as defined by the appended claims.

I claim as my invention:

1. An inner tube recreational vehicle for supporting a person or other matter thereon, said inner tube recreational vehicle comprising:

an inflatable inner tube having a central opening therethrough;

a seat, said seat comprising a plurality of straps each having a free end, each said strap being connected to another said strap by a first connection means, each said strap further having a second connection means located on said free end thereof, each said strap having a third connection means located between said second connection means and said first connection means, said second connection means and said third connection means being adapted for coupling to each other, each said strap having a fourth connection means located between said second connection means and said third connection means, and said seat further comprising a rope, said rope being attached to each said fourth connection means;

wherein said inner tube recreational vehicle is formed by locating said first connection means in the center of said central opening, passing said free ends of said straps around said inner tube and coupling said second connection means and said third connection means to each other and thereby encircling the periphery of said inner tube with said rope attached at said fourth connection means and providing said seat within said central opening of said inflatable inner tube.

2. An inner tube recreational vehicle for supporting a person or other matter thereon, said inner tube recreational vehicle comprising:

an inflatable inner tube having a central opening therethrough;

a seat, said seat comprising a plurality of straps having a first and a second free end, each said strap being connected to another said strap intermediate the free ends thereof by a first connection means, each said strap further having a second connection means located on each free end thereof, each said strap having a third connection means located between said second connection means and said first connection means, said second connection means and said third connection means being adapted for coupling to each other, each said strap having a fourth connection means located between each said second connection means and said third connection means, and said seat further comprising a rope, said rope being attached to each said fourth connection means;

wherein said inner tube recreational vehicle is formed by locating said first connection means in the center of said central opening, passing each said second free end of said straps around said inner tube and coupling said second connection means and said third connection means to each other and thereby encircling the periphery of said inner tube with said rope attached at said fourth connection means and providing said seat within said central opening of said inflatable inner tube.

* * * * *